US009322153B2

(12) United States Patent
Melheim

(10) Patent No.: US 9,322,153 B2
(45) Date of Patent: Apr. 26, 2016

(54) DEGRADABLE SANITARY RING

(71) Applicant: Thomas P. Melheim, Encinitas, CA (US)

(72) Inventor: Thomas P. Melheim, Encinitas, CA (US)

(73) Assignee: SINK RING, LLC, Encinitas, CA (US)

( * ) Notice: Subject to any disclaimer, the term of this patent is extended or adjusted under 35 U.S.C. 154(b) by 248 days.

(21) Appl. No.: 14/180,013

(22) Filed: Feb. 13, 2014

(65) Prior Publication Data

US 2014/0223651 A1 Aug. 14, 2014

Related U.S. Application Data

(60) Provisional application No. 61/764,989, filed on Feb. 14, 2013.

(51) Int. Cl.
*E03D 9/02* (2006.01)
*E03C 1/126* (2006.01)

(52) U.S. Cl.
CPC ..... *E03C 1/126* (2013.01)

(58) Field of Classification Search
CPC ..... A61B 10/007
USPC ..... 4/209 R–209 FF
See application file for complete search history.

(56) References Cited

U.S. PATENT DOCUMENTS 1,164,418 A * 12/1915 Smith ..... A01M 1/2055 148/DIG. 118
4,578,207 A * 3/1986 Holdt ..... A61L 9/05 510/192
5,759,574 A * 6/1998 Bothe ..... A61L 9/05 424/464
5,997,901 A * 12/1999 Mills ..... A61K 8/02 424/400
6,235,127 B1 * 5/2001 Rader ..... C11D 1/37 134/34
6,589,924 B2 * 7/2003 Schmidt ..... C11D 3/0052 510/191
6,703,012 B1 * 3/2004 White ..... A61L 9/042 424/489
6,713,441 B1 * 3/2004 DeSenna ..... C11D 3/0052 422/5
6,770,616 B1 * 8/2004 McGowan ..... C11D 3/2075 510/224
7,563,756 B2 * 7/2009 Brady ..... E03D 9/007 422/5
2002/0061831 A1 * 5/2002 Kaziska ..... C11D 3/0052 510/446
2002/0187119 A1 * 12/2002 Greer ..... A61L 9/05 424/76.2
2007/0252773 A1 * 11/2007 Soler Castany ..... H01Q 1/242 343/846
2015/0320158 A1 * 11/2015 Duffy, Jr. ..... A44C 17/00 75/230
2015/0332031 A1 * 11/2015 Mistry ..... G06F 21/316 726/19

* cited by examiner

*Primary Examiner* — Lori Baker

(74) *Attorney, Agent, or Firm* — Coastal Patent Law Group, P.C.

(57) ABSTRACT

A degradable sanitary ring configured for nesting within a drain portion of a sink, such as a kitchen sink or bathroom sink, is further configured to elute one or more sanitizing agents as the ring degrades. The sanitizing agents may include antimicrobial agents or scented oils. The degradable sanitary ring is used to improve sanitation in and around the sink area.

12 Claims, 2 Drawing Sheets

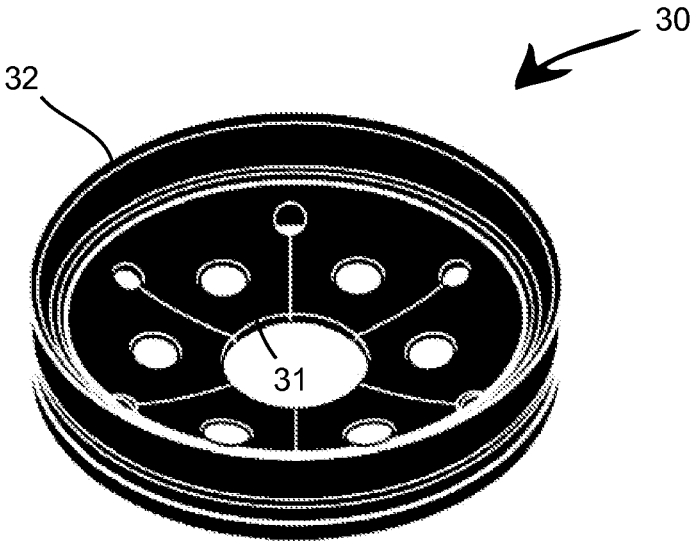
FIG.3
FIG.4A
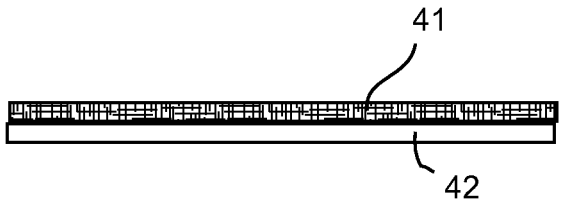
FIG.4B
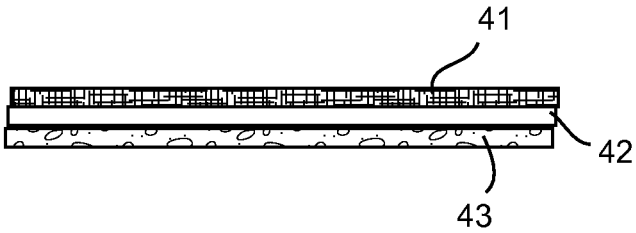

DEGRADABLE SANITARY RING

CROSS-REFERENCE TO RELATED APPLICATIONS

This application claims benefit of priority with U.S. Ser. No. 61/764,989, filed Feb. 14, 2013; the contents of which are hereby incorporated by reference.

BACKGROUND OF THE INVENTION

1. Field of the Invention

This invention relates to household sanitation products; and more particularly to a degradable polymer device configured to be received in a conventional sink and further configured for eluting at least one of a scented fragrance or antimicrobial agent therefrom.

2. Description of the Related Art

Sinks and garbage disposals require periodic maintenance for cleaning debris and build-up from within the sink or garbage disposal unit in order to prevent, reduce or eliminate odor. If left unattended for prolonged durations, or if not properly maintained, a foul odor will often develop at the sink or disposal unit which can cause a nuisance to anyone within the immediate vicinity.

To combat odors from within a sink or disposal unit, many products are currently available. For example, various products containing scented oils, antimicrobial agents, and/or chemicals are adapted for delivery to the disposal unit and rupture by way of grinding within the disposal thereby releasing the contents for treatment within the sink or disposal unit. Though these products tend to remove or mask the odor initially, the odor often recurs as the product is washed away.

Accordingly, it would be beneficial to provide a product adapted for prolonged treatment of odors and odor causing buildup, such that scented oils, antimicrobial agents, and/or chemicals may be continuously delivered for providing ongoing treatment of a sink and/or disposal unit.

SUMMARY OF THE INVENTION

In various embodiments, a degradable sanitary ring is provided comprising a degradable polymer configured to erode over time for providing sustained release of embedded compositions including scented oils, antimicrobial agents, and/or chemicals for ongoing sanitary treatment within a sink or garbage disposal unit. The ring is configured for positioning within a sink and further configured to elute one or more sanitizing agents without obstructing sink functionality or washing away down the drain.

The sanitary ring is generally configured for nesting within a drain portion of a sink or garbage disposal unit. Various embodiments include a ring embodiment, a flange embodiment, and a splash-guard embodiment, among others.

The sanitary ring may be configured to receive and contain an inserted polymer ring or other inserted component containing the degradable sanitizing agent.

Other features are described in the following detailed description.

BRIEF DESCRIPTION OF THE DRAWINGS

FIG. 3 illustrates a degradable sanitary ring in accordance with a splash-guard embodiment.

FIG. 4A shows a degradable sanitary ring with a single-layer coating over a non-degradable structure.

FIG. 4B shows a degradable sanitary ring with a multiple coating layers, each layer comprising a distinct degradable coating.

DETAILED DESCRIPTION OF THE PREFERRED EMBODIMENTS

Figure 1:
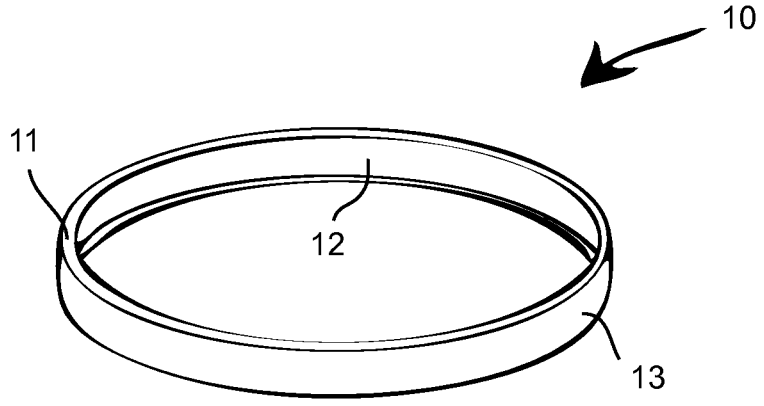
FIG. 1 illustrates a degradable sanitary ring in accordance with a ring embodiment.

A degradable sanitary ring is described for providing sustained release of scented oils, antimicrobial agents, and/or chemicals. The degradable sanitary ring is generally configured for nesting within a drain portion of a sink or garbage disposal unit.

Scented oils are well known by those having skill in the art and will not be described in detail herein; however one may perform an internet search for "scented oils" to determine a list of potential candidates for scents in producing a degradable sanitary ring in accordance with one or more embodiments herein.

Degradable polymers, for example poly-L-Lactic acid (PLLA), starch-polycarbonates, and numerous other degradable polymers are well known by those having skill in the art and thus such degradable polymers will not be discussed in detail herein.

U.S. Pat. No. 5,997,901, hereinafter the '901 patent, describes methods for manufacturing scented molded products and can be referenced by those having skill in the art as an example for enabling the manufacture of molded products containing scented oils.

Anti-microbial agents are also well known and can be embedded in degradable polymers in accordance with various methods known in the art. For purposes herein, an "antimicrobial agent" is any agent that kills microorganisms or inhibits their growth.

The invention is characterized by a unique and unrecognized need for treatment of sinks against odors and odor-causing substances such as bacteria. Rather than grinding down a product for immediate and limited-durational use, the embodiments disclosed herein provide a continued treatment of a sink for a prolonged duration. In various embodiments, the inventive product comprises a ring like structure configured to generally nest within a drain portion of a sink or garbage disposal unit. As water is used within the sink over time, the product erodes and thereby releases embedded agents such as scented oils, anti-microbial agents, and others.

One problem recognized by the named inventor was discovered during product development, wherein a ring eroded too quickly and thus was unable to remain positioned within the drain of a sink long enough to provide sustained treatment. To overcome this problem, it has been recognized that an amount of crystallization or crosslinking of the polymer can be addressed for yielding a rigid structure that both provides sustained release but also remains rigid enough to remain in position. A flange can also be incorporated to provide additional retaining support within the sink drain portion.

Another solution gives rise to embodiments comprising a rigid non-degradable structure coated with a degradable polymer for sustained release. In this regard, it can be desirable to coat a first side of a rigid structure, wherein the first side is configured for exposure within the drain whereas a second side is not coated and is configured to nest against the surface of the drain. In this regard, the product is configured to remain structurally rigid while also providing the degradable polymer for sustained release of various useful agents.

In certain embodiments it has been further recognized that the device can be coated or formed with several independent layers, each layer having a unique rate of polymer erosion, such that a first layer may be adapted to quickly dissolve whereas a second and subsequent layers may progressively increase or decrease with respect to erosion rate depending on the desired result.

Chemicals for treating certain sinks may include bleach or a bleach alternative. These bleach type compositions are well known in the art and will not be discussed in detail here.

Now turning to the drawings, FIG. 1 illustrates a degradable sanitary ring configured for nesting within a drain portion of a sink or garbage disposal unit, the degradable sanitary ring 10 comprises: an annular structure having an inner surface 12, an outer surface 13, and a rim 11.

In an embodiment, the ring is molded using a degradable polymer having one or more agents embedded therein, the agents being selected from: scented oils, antimicrobial agents, and bleaching chemicals.

In another embodiment, the ring comprises a rigid non-degradable annular structure that is coated with a degradable polymer containing the one or more embedded agents.

Figure 2:
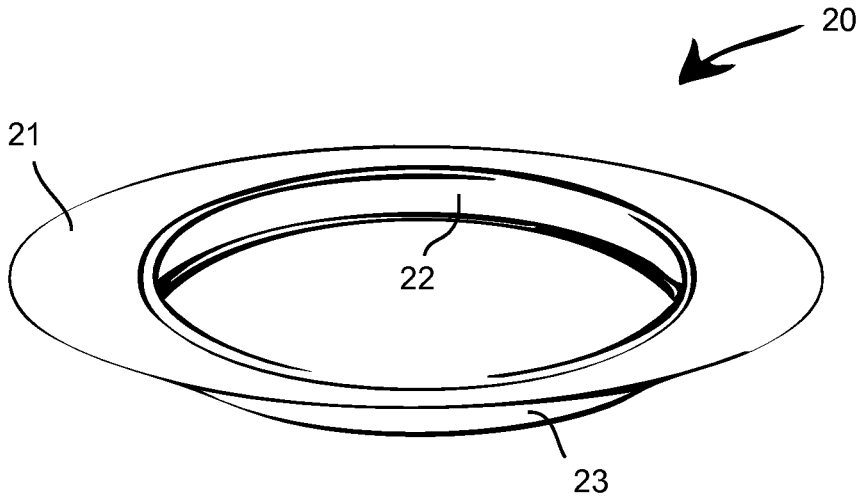
FIG. 2 illustrates a degradable sanitary ring in accordance with a flange embodiment.

FIG. 2 illustrates a degradable sanitary ring 20 in a flange embodiment, comprising an inner surface 22, and outer surface 23, and a flange 21 extending horizontally outwardly from the ring body.

The degradable sanitary ring of FIG. 2 may also be formed of a degradable polymer. Alternatively, it may be formed from a non-degradable polymer and further coated with a degradable polymer as described above.

FIG. 3 illustrates a degradable sanitary ring in a splash-guard embodiment, comprising an annular ring structure 32 having an outer surface, and inner surface, and a plurality of flaps 31 extending radially inwardly. The splash-guard may be molded using a degradable polymer containing the one or more agents. Alternatively, the splash-guard ring may be molded form a non-degradable polymer and further coated with a degradable polymer containing the one or more agents.

FIG. 4A illustrates a degradable sanitary ring with a single-layer coating, wherein the degradable sanitary ring in accordance with any of the above embodiments may be fabricated to comprise a non-degradable structure 41 being coated with a degradable polymer 42 having one or more of the agents embedded therein, such as a scented oil, and antimicrobial agent, and/or bleach.

FIG. 4B illustrates a degradable sanitary ring with a multi-layer coating, wherein the degradable sanitary ring in accordance with any of the above embodiments may be fabricated to comprise a non-degradable structure 41 being coated with a first layer of degradable polymer 42 having one or more of the agents embedded therein, and a second layer of degradable polymer 43 having one or more of the agents embedded therein; such as a scented oil, and antimicrobial agent, and/or bleach. Two or more layers can be provided, wherein each layer is configured for a distinct erosion rate. The two or more layers can optionally each comprise a distinct sanitizing agent.

It is important that the degradable sanitary ring be configured to nest within a drain portion of a sink or adjacent to a garbage disposal unit such that treatment of the sink results in reduction of odors, bacteria, or other related nuisances. Water traveling about the drain is used in conjunction with the degradable ring to cause erosion of one or more portions of the ring such that the embedded sanitizing agents may be released.

For purposes herein, the term "bleach chemical" may refer to chlorine bleach or a bleach alternative.

In certain embodiments the degradable sanitary ring can be configured with an erosion rate of about 30 days with sink use in an average household of four. Depending on the amount of sink use and flowing water, humidity, and other variables the erosion rate may be plus or minus about 10 days.

In certain other embodiments, the degradable sanitary ring can be configured for increased longevity, for example by using a higher composition of crosslinked polymer or other methods known in the art, such that the degradable sanitary ring can be configured with an erosion rate of about 90 days.

Various methods for fabricating biodegradable, erodible polymers are known in the art and with minor variation can be implemented to vary the longevity and erosion rate of the sanitary ring.

In another embodiment, the sanitary ring is configured with a mesh or webbing extending inward from the annular body to form a strainer.

In another embodiment, the flange can be configured with an adhesive for attaching to the bottom portion of a sink.

Example 1

In one example, a degradable sanitary ring comprises: an annular body structure having an inner surface and an outer surface, the outer surface being configured for nesting against a surface of the drain portion of a sink for securely fixing therebetween; the annular body structure is molded from a degradable polymer having one or more sanitizing agents embedded therein.

The degradable sanitary ring is formed of a blend of starch and polypropylene configured for injection molding. The blend includes between 30% and 65% wheat starch by weight, 35% to 70% polypropylene, and one or more sanitizing additives such as scented oils, antimicrobial agents, a bleach chemical, and coloring additives. The composition of the blend can be adjusted to yield a desired erosion rate, for example by increasing the amount of polymer to starch the erosion rate is increased.

The blend is processed by way of injection molding to form the annular body structure of the degradable sanitary ring. The ring may optionally include one or more flanges extending radially inward, outward, or in both directions. Any flange (s) are formed using an appropriate mold.

The molded sanitary ring is positioned in a drain portion of a sink or disposal unit. As water is used within the sink, the ring slowly erodes to release the one or more embedded sanitizing agents. Eventually, the ring is completely dissolved and is replaced with another ring.

Example 2

In another example, a sanitary ring is configured for placement within a sink and comprises a portion which is non-degradable and configured with a degradable polymer coating having one or more sanitizing agents embedded therein. The non-degradable portion can be fabricated by injection molding or other methods, and is further processed by applying one or more coats of the degradable polymer thereon to form the coated device. In this regard, the entire device does not erode but the biodegradable coating does, thereby eluting the one or more sanitizing agents therewith.

Example 3

In yet another example, a sanitary ring is configured for placement within a sink and comprises a portion which is non-degradable and configured to receive a material insert including one or more sanitizing agents. In this regard, the sanitizing ring is refillable by way of inserting a fresh material insert.

I claim:

1. A degradable sanitary ring configured for nesting within a drain portion of a sink, the degradable sanitary ring comprising:

an annular body structure having an inner surface and an outer surface, the outer surface being configured for nesting against a surface of the drain portion of the sink for securely fixing therebetween;

the annular body structure being one of:

molded from a degradable polymer having one or more sanitizing agents embedded therein, or coated with a degradable polymer having one or more sanitizing agents embedded therein;

wherein said one or more sanitizing agents comprises at least one of: a scented oil, or an antimicrobial agent.

2. The degradable sanitary ring of claim 1, said sanitary ring further comprising a flange extending radially outward from the annular body structure.

3. The degradable sanitary ring of claim 1, said sanitary ring further comprising one or more flaps extending radially inward from the annular body structure, the flaps further comprising one or more slits and one or more apertures for channeling water and other material therethrough.

4. The degradable sanitary ring of claim 1, said annular body structure is coated with said degradable polymer having one or more agents embedded therein, wherein said degradable polymer coated on said annular body structure comprises two or more polymer layers.

5. The degradable sanitary ring of claim 4, wherein said two or more polymer layers comprises a first layer having a first erosion rate, and a second layer having a second erosion rate that is distinct from the first erosion rate.

6. The degradable sanitary ring of claim 4, wherein said two or more polymer layers comprises a first layer having a first sanitizing agent, and a second layer having a second sanitizing agent that is distinct from the first sanitizing agent.

7. The degradable sanitary ring of claim 1, wherein said one or more sanitizing agents comprises a scented oil and an antimicrobial agent.

8. A degradable sanitary ring configured for nesting within a drain portion of a sink, comprising:

an annular body structure having an inner surface and an outer surface, the outer surface being configured for nesting against a surface of the drain portion of the sink for securely fixing therebetween;

a flange extending outwardly from the annular body portion; and a biodegradable polymer composition having one or more sanitizing agents embedded therein;

wherein said one or more sanitizing agents comprises at least one of: a scented oil, or an antimicrobial agent.

9. The degradable sanitary ring of claim 8, wherein said biodegradable polymer composition forms a coating about the annular body and flange.

10. The degradable sanitary ring of claim 9, wherein said annular body and flange are formed from a non-degradable composition.

11. The degradable sanitary ring of claim 8, comprising a material insert positioned about the ring, wherein the material insert is formed from the biodegradable polymer composition.

12. The degradable sanitary ring of claim 8, wherein said annular body and said flange are formed of the biodegradable polymer composition.

* * * * *